US005318293A

United States Patent [19]

Nathanson et al.

[11] Patent Number: 5,318,293

[45] Date of Patent: Jun. 7, 1994

[54] SPINNING BALL

[75] Inventors: Theodore Nathanson, Scarsdale; Judd D. Nathanson, Yonkers, both of N.Y.; James Caporale, Watertown, Conn.; Thomas J. Zoltner, Denville, N.J.

[73] Assignee: Douglas Products Corporation, Yonkers, N.Y.

[21] Appl. No.: 62,299

[22] Filed: May 14, 1993

[51] Int. Cl.[5] ..... A63B 37/14; A63H 1/00

[52] U.S. Cl. ..... 273/58 A; 273/65 EF; 273/58 R; 446/236

[58] Field of Search ..... 273/58 R, 58 A, 1.5 A, 273/65 R, 65 A, 65 EF, DIG. 20, 65 EG, 58 G, 58 K; 446/240, 236, 46; 384/245

[56] References Cited

U.S. PATENT DOCUMENTS

| | | | |
|---|---|---|---|
| 2,300,362 | 10/1942 | Shotter | 384/245 |
| 3,865,378 | 2/1975 | McPhail et al. | 273/128 A |
| 3,884,466 | 5/1975 | MacDonald et al. | 273/65 EC |
| 3,975,016 | 8/1976 | Bodor | 273/65 EF |
| 4,040,625 | 8/1977 | Malafronte | 446/46 |
| 4,113,257 | 9/1978 | Moffatt | 273/185 C |
| 4,919,422 | 4/1990 | Ma | 273/26 R |
| 5,067,923 | 11/1991 | de Bourbon | 446/236 |

FOREIGN PATENT DOCUMENTS

| | | | |
|---|---|---|---|
| 2187969 | 9/1987 | United Kingdom | 446/46 |

*Primary Examiner*—Vincent Millin
*Assistant Examiner*—Steven B. Wong
*Attorney, Agent, or Firm*—Leonard Bloom

[57] ABSTRACT

A simple and economical spin fixture which is specially designed to be integrally molded, implanted or otherwise embedded within a solid composition ball, for example, a polymerized thermoplastic foam basketball. The fixture rotatably seats one's fingertip inside the ball to allow effortless fingertip spinning. The gripping action is secure, and yet the frictional contact surface between the rotating and stationary parts is minimized to improve the spin quality.

17 Claims, 3 Drawing Sheets

SPINNING BALL

BACKGROUND OF THE INVENTION

1. Field of the invention

The present invention relates to novelty balls, and more particularly, to a solid composition ball having an embedded spin fixture to allow fingertip spinning of the ball.

2. Description of the Prior Art

Recent improvements in molding methods have engendered a wide variety of novelty balls formed of polymerized thermoplastic foam. For example, numerous solid foam footballs are commercially available in various precision-molded shapes and sizes, and such balls enjoy widespread commercial popularity.

Lately, the popularity of such balls has been propagated by new and imaginative novelty features. For instance, the capability now exists to precision-mold such balls with helical grooves to facilitate throwing, and/or central air passages to improve the aerodynamics. U.S. Pat. No. 4,919,422 issued to Ma. shows an exemplary polyurethane foam throwing-ball with non-uniform grooves for altering the flight path.

It is also possible to mold such balls with embedded solid structures. Solid support frameworks, weights, whistles, and numerous other plastic structures are now commonly implanted or integrally molded within the balls. As an example, U.S. Pat. No. 3,884,466 issued to MacDonald et al. discloses an aerodynamic football having a constricted air passage formed centrally through the ball. A pair of disks 32 and 34 are integrally molded within the body of the ball to provide support and stabilizing weight.

With state-of-the-art molding methods, the possibilities for other novelty features are limited only by the imagination. A particularly promising novelty feature had its origin in a different context, namely, inflatable balls. U.S. Pat. No. 3,975,016 issued to Bodor discloses a spin fixture for an inflatable ball which simplifies fingertip spinning. Fingertip spinning of a basketball is a very popular stunt. However, it is an extremely difficult maneuver using a conventional basketball. Bodor '016 attempts to solve this problem by incorporating a novelty spin fixture in a conventional inflatable basketball. The fixture includes a rotator 4 which sits on an annular bearing 6 which is in turn seated within a housing 3. The fixture is inserted through a perforation in the wall of the ball and is seated flush therewith, the wall being fused around the housing 3. The rotator 4 remains exposed to provide a seating for the fingertip. In addition, both rotator 4 and bearing 6 accommodate insertion of an air needle for inflation of the ball.

It would be greatly advantageous to provide a spin fixture to be implanted or integrally molded within a solid composition ball, for example, a polymerized thermoplastic foam basketball. Unfortunately, the Bodor '016 fixture is not well suited for this type of ball. The flange of housing 3 would be inappropriate for anchoring the fixture within a solid ball. In addition, the Bodor '016 device also has a large area of frictional contact between the bearing 6 and rotator 4. This contact surface is insignificant in a heavy conventional basketball where the resulting friction is overcome by momentum. However, in a lighter solid composition ball the friction would seriously interfere with the spin quality. Furthermore, the rotator 4 of Bodor '016 is shallow and provides minimal support on the fingertip.

There would be great commercial promise in a solid composition ball with spin fixture which avoided the above-described drawbacks.

SUMMARY OF THE INVENTION

It is, therefore, an object of the present invention to provide a spin fixture which is specifically designed to be implanted or integrally molded within a solid composition ball such as a polymerized thermoplastic foam basketball or the like.

It is a more specific object to provide a spin fixture which remains securely anchored inside a solid composition ball with a rotatable finger receptacle giving a flush outward appearance with the exterior surface of the ball.

It is another object to provide an improved spin fixture with a secure deep-well finger receptacle formed of rubber or the like and having optional interior ribs for improving one's grip.

It is still another object to minimize the frictional contact surface between the rotating and stationary parts to thereby improve the spin quality.

It is another object to minimize the manufacturing cost of a ball and spin fixture having the above-described qualities.

According to the present invention, the above-described and other objects are accomplished by providing a spin fixture which is specially designed to be integrally embedded in a solid composition ball, for instance, a polymerized thermoplastic foam basketball. The spin fixture of the present invention greatly assists in fingertip spinning of the ball and gives an outward appearance of great skill and dexterity. The spin fixture includes a housing defining a hollow cylindrical chamber which is open at one end and closed at the other. The closed end of the housing is formed with a centrally located bearing seat projecting inwardly into the chamber. The open end of the housing is formed with an inwardly projecting rim encircling the periphery. A cylindrical rotator is enclosed within the housing and is held captive therein between the bearing seat and the rim of the housing. The rotator also has an open end and a closed end, and further comprises a dimple projecting centrally outward at the closed end for rotatable bearing contact in the bearing seat, and a central finger well providing fingertip access at the open end of the rotator. The finger well tapers toward the closed end to firmly grip fingers of varying sizes. In practice, the user inserts her middle finger and spins the ball. The ball is easily maintained in alignment on the finger while the housing (and ball) spins about the rotator. Since the friction is minimized between the contacting parts, fingertip spinning can be prolonged.

BRIEF DESCRIPTION OF THE DRAWINGS

Other objects, features, and advantages of the present invention will become more apparent from the following detailed description of preferred embodiments and certain modifications thereof when taken together with the accompanying drawings in which.

DETAILED DESCRIPTION OF THE PREFERRED EMBODIMENT

Figure 1:
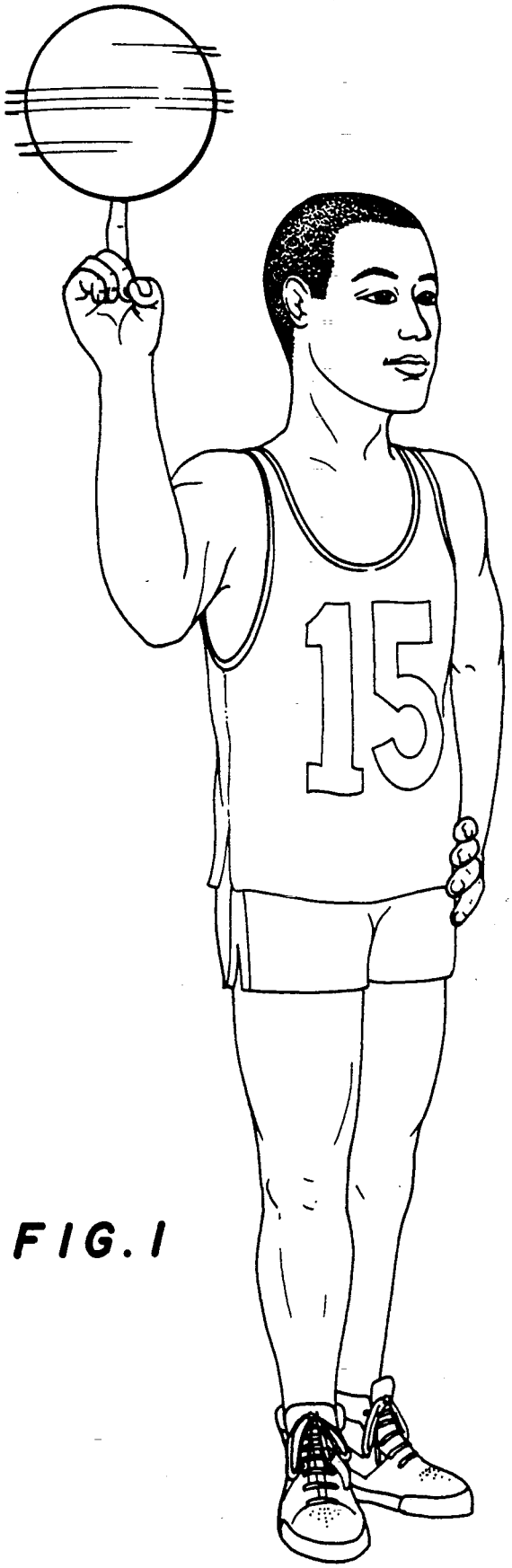
FIG. 1 is a perspective illustration showing the technique of fingertip basketball spinning.

FIG. 1 illustrates the proper technique for fingertip spinning of a basketball. This has long been a popular stunt for demonstrating one's basketball prowess. However, fingertip spinning requires a combination of great dexterity and disciplined practice.

There are many who would like to demonstrate the skill but are unwilling to devote the time or energy to develop it. It would be a novel privilege for these unfortunates to give the appearance that they possess the skill. The present invention offers a solution. The spin fixture of the present invention allows a person utterly lacking the spin ability to give a contrary appearance.

The invention is specially designed to be embedded within a solid composition ball. For example, the fixture may be implanted or integrally embedded in a polymerized thermoplastic foam basketball. However, it should be recognized that the fixture of the present invention may be embedded in virtually any type of ball formed of any solid material. Therefore, an appropriate range of equivalents are considered to be within the spirit and scope of the invention.

Figure 2:
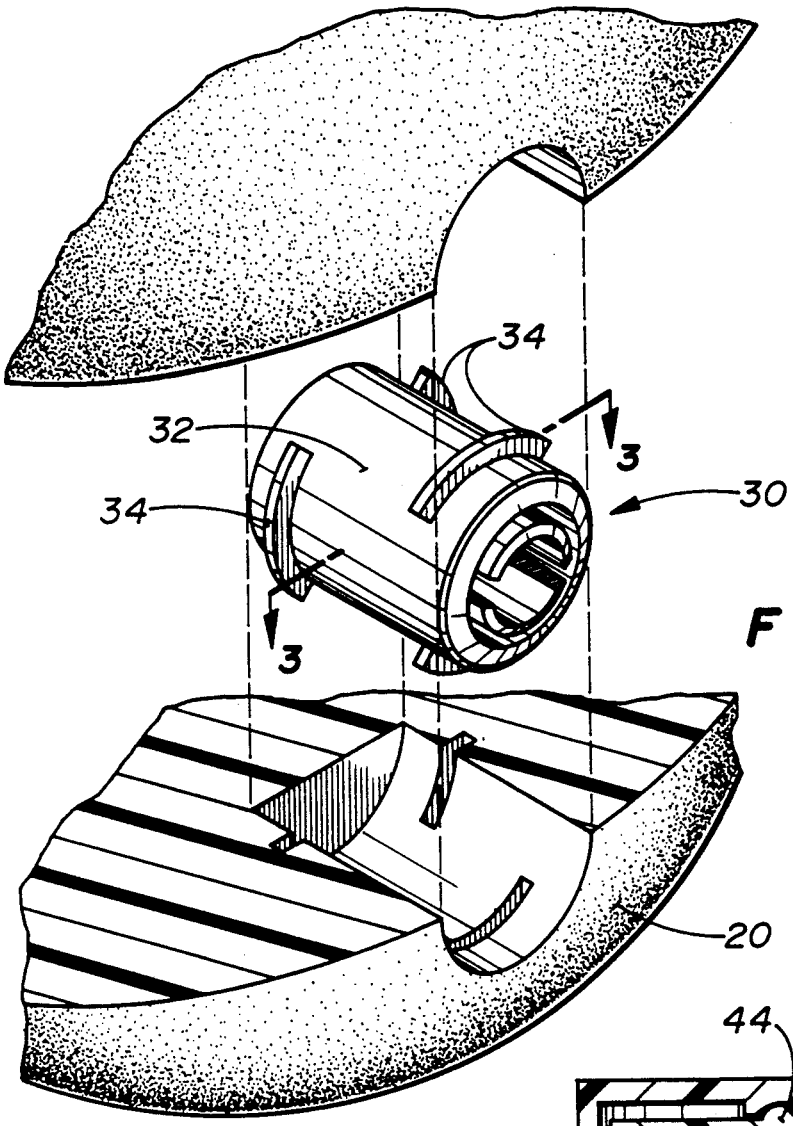
FIG. 2 is a perspective view of a fingertip spin assembly 30 according to one embodiment of the present invention shown between exploded halves 10 and 20 of a ball.

FIG. 2 is an exploded perspective view of a fingertip spin assembly 30 sandwiched between discrete halves 10 and 20 of a solid composition ball. The ball halves 10 and 20 may be thermally joined or glued together to form the final product. Alternatively, a one-piece composition ball may be molded at the outset with a cavity for the spin fixture 30 included, and the spin fixture 30 may be implanted therein. Given current molding techniques, it is also possible to integrally mold the entire ball with spin fixture 30 already embedded.

Spin fixture 30 is contained within a cylindrical housing 32, and housing 32 is preferably formed from urethane or other hard but resilient plastic. Housing 32 is provided with a series of arcuate fins 34 protruding outwardly therefrom. Fins 34 serve to anchor housing 32 within the molded ball halves 10 and 20. In the illustrated embodiment, four fins 34 are patterned sequentially around housing 32 at 90° intervals, the fins 34 being further arranged in pairs at opposing ends of the housing 32. The illustrated pattern of fins 34 provides an extremely secure anchor for retaining housing 32 within the foam of halves 10 and 20. Moreover, the retaining force generated by fins 34 is evenly dispersed around the entire 360° perimeter of housing 32. Alternate patterns of anchoring fins 34 are contemplated to be within the scope of the invention. For instance, a plurality of continuous 360° annular flanges may be equally spaced lengthwise along cylindrical housing 32.

Figure 3:
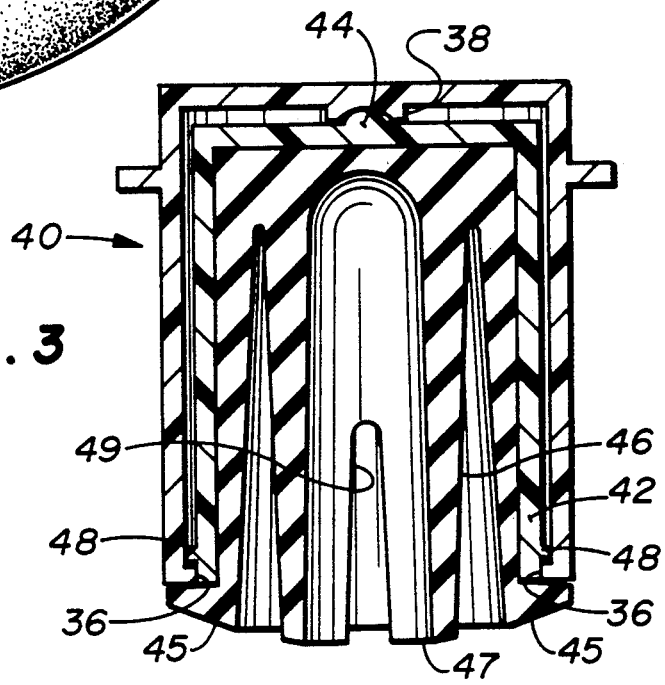
FIG. 3 is a side cross-sectional view of the spin assembly 30 of FIG. 2.

As shown in FIG. 3, cylindrical housing 32 defines a hollow cylindrical chamber which is closed at one end by a bottom wall. The bottom wall of housing 32 is formed with a centrally located bearing seat 38 projecting into the hollow chamber. Housing 32 is preferably formed of hard plastic or other low-friction material. The open end of housing 32 is formed with an inwardly projecting rim 36.

A rotator 40 is enclosed within housing 32 and is held captive therein by rim 36. Rotator 40 further comprises an outer shell 42, which is preferably formed from hard plastic, and an interior finger cup 46, which may be formed of soft rubber, foam, or any other suitable gripping material. Outer shell 42 is a substantially cylindrical member having a closed end formed with a central dimple 44. Dimple 44 conforms to bearing seat 38 and is rotatably urged against the bearing seat 38 by rim 36 of housing 32.

The diameter of outer shell 42 is less than that of housing 32 such that a small clearance is introduced between the two parts. A small flange 48 is provided around the outer periphery of outer shell 42 near the open end. Flange 48 bears against the rim 36 of housing 32 thereby maintaining the rotator 40 captive therein with dimple 44 engaging bearing seat 38. The spacing between flange 48 and the open end of outer shell 42 should be equal to the thickness of rim 36. This way, the open end of outer shell 42 is self-aligning with the open end of housing 32.

The rotator 40 remains free to spin within housing 32 and the only frictional points of contact are those between dimple 44 and bearing seat 30, and between flange 48 and rim 36. This minimizes the friction between the moving parts and allows for smooth and prolonged fingertip spinning of the ball.

Preferably, flange 48 is formed in the shape of an annular graduated ramp having a vertical precipice facing the open end of outer shell 42. With this configuration, the rotator 40 may be conveniently snapped in place. Specifically, rotator 40 may be inserted within housing 32. As the rim 36 of housing 32 climbs over the ramped flange 48, the rotator 40 will snap into housing 32 in the properly seated position.

Rotator 40 also comprises a finger cup 46 which is secured within the outer shell 42. The finger cup 46 may be formed of rubber, silicone, foam, or any other suitable material which provides a firm grip. Finger cup 46 is preferably a substantially cylindrical member which is properly sized for a secure compression fit within the outer shell 42. In the preferred embodiment, finger cup 46 is defined by a deep annular notch tapering inwardly from the open end. The annular notch surrounds a central finger-well extending inwardly from the open end. The annular notch and finger-well isolate a resilient finger collar 47. Finger collar 47 is designed to embrace a substantial portion of a human finger, and to firmly grip the finger by a secure compressive resilient fit. The resiliency may be increased by forming the finger collar with or more slits 49 extending inwardly from the open end. Two slits 49 are shown in the illustrated embodiment. However, the length and number of slits 49 may be varied to achieve the desired resiliency. Finger cup 46 may also be formed with a contoured flange 45 around the open end. The contoured flange 45 conforms to the spherical surface of the ball and helps to give a flush appearance.

In practice of the above-described spin fixture 30, one's finger is inserted within the collar 47 of rotator 40 while the remaining fingers are used to grip and spin the ball. Since collar 47 maintains the inserted finger in alignment with the spinning axis of the ball, there is little tendency of the ball to fly off the finger. Hence, the ball may be spun effortlessly at the fingertip for a prolonged period of time, thereby giving the appearance of great manual dexterity.

Although it is desirable to provide a finger cup 46 with a high degree of resiliency (to conform to different fingers) while minimizing the resiliency of outer shell 42

(to thereby reduce the friction), it should be appreciated that outer shell 42 and finger cup 46 may be combined into a one-piece integrally molded part in order to reduce manufacturing costs.

Figure 4:
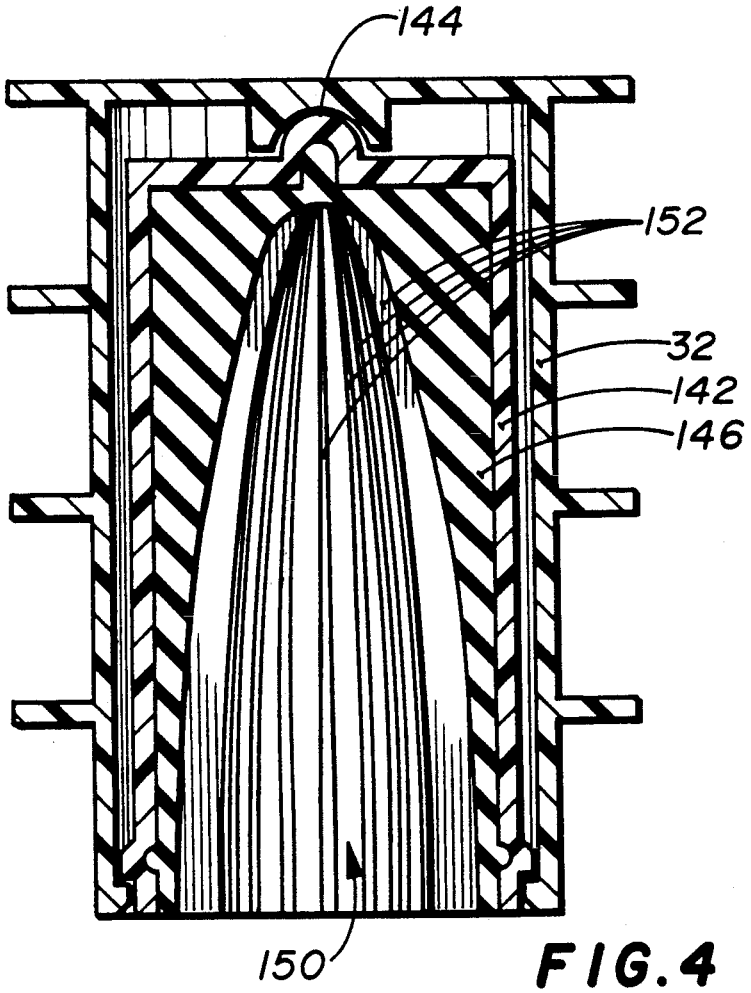
FIGS. 4 and 5 are side cross-sectional and top views, respectively, showing an alternative embodiment of a finger cup 46 which is better adapted to grip and accommodate fingers of various sizes.
Figure 5:
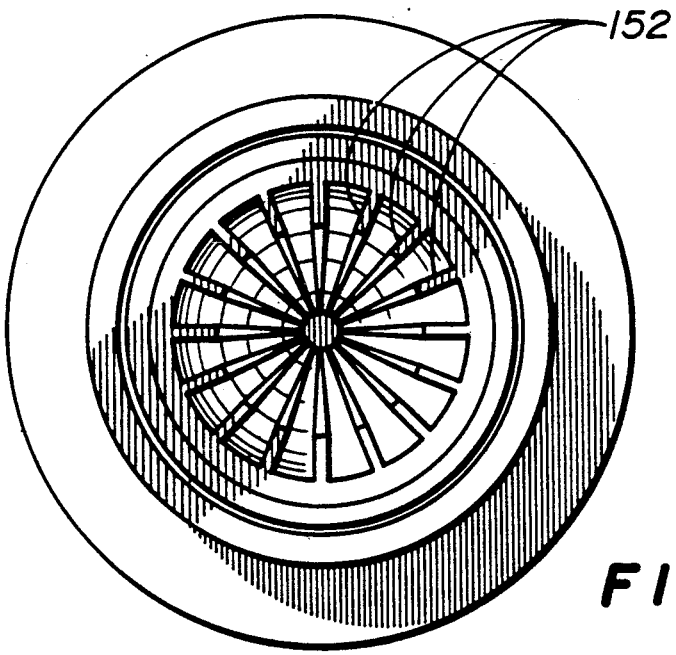

FIGS. 4 and 5 illustrate an alternative embodiment of a finger cup 146 which is better adapted to accommodate fingers of varying sizes. The annular notch in finger cup 46 which defines the finger collar 47 of the previously described embodiments has been eliminated, and a single tapered finger-well 150 is provided instead. Finger-well 150 is centrally formed in finger cup 146 and tapers gradually from an enlarged open end to an abbreviated end which approaches dimple 144. The wide open end of finger-well 150 is better suited for accommodating a broader range of finger sizes. To insure that the quality of the grip is not compromised, outwardly projecting axial ribs 152 may be formed along the interior surface of the finger well of finger cup 146.

Having now fully set forth the preferred embodiments and certain modifications of the concept underlying the present invention, various other embodiments as well as certain variations and modifications of the embodiment herein shown and described will obviously occur to those skilled in the art upon becoming familiar with said underlying concept. It is to be understood, therefore, that within the scope of the appended claims, the invention may be practiced otherwise than as specifically set forth herein.

We claim:

1. A spin fixture to be embedded in a solid composition ball to assist in fingertip spinning thereof, said fixture comprising:

a housing defining a hollow cylindrical chamber open at one end and closed at another end, the closed end of said housing being formed with a centrally located bearing seat projecting inwardly in said chamber, and the open end of said housing being formed with an inwardly projecting rim around a periphery; and a cylindrical rotator enclosed within said housing and held captive therein by said rim, said rotator having an open end and a closed end, a dimple projecting centrally outward from said closed end for rotatable bearing contact in said bearing seat, and a central finger well providing fingertip ingress from the open end of said rotator.

2. The spin fixture of claim 1, wherein said cylindrical rotator is formed with an annular flange protruding outwardly proximate the open end, said flange bearing against the rim of said housing to hold said rotator captive therein.

3. The spin fixture of claim 2, wherein said annular flange of said cylindrical rotator is formed with a graduated ramping cross-section having a precipice facing the open end of the outer shell to allow snap-fit insertion of said rotator in said housing.

4. The spin fixture of claim 2, wherein said cylindrical rotator further comprises, a hard outer shell, and a resilient finger cup inserted within said outer shell and defining said central finger well.

5. The spin fixture of claim 4, wherein said central finger well tapers inwardly toward the closed end of said finger cup, and said finger cup is provided with a plurality of axially spaced ribs protruding into said central finger well for securely gripping a finger inserted therein.

6. The spin fixture of claim 4, wherein said resilient finger cup further comprises a resilient finger collar defined by an annular notch cutting into said finger cup around said central finger well and tapering inwardly from the open end.

7. The spin fixture of claim 6, wherein said finger collar is formed with at least one axial slit for increasing its resiliency when a finger is inserted therein.

8. A spinning ball which simplifies fingertip spinning thereof, comprising:

a unitary solid composition ball:

a spin fixture embedded in said ball, said spin fixture further comprising, a housing defining a hollow cylindrical chamber open at one end and closed at another end, said closed end of the housing being formed with a centrally located bearing seat projecting inwardly in said chamber, and the open end of said housing being formed with an inwardly projecting peripheral rim, and a cylindrical rotator enclosed within said housing and held captive therein by said rim, said rotator having an open end, a closed end, a dimple projecting centrally outward from said closed end for rotatable bearing contact in said bearing seat, and a central finger well providing fingertip access from the open end of said rotator.

9. The spinning ball of claim 8, wherein said spin fixture housing is formed with exterior fins for anchoring said spin fixture within said unitary foam ball.

10. The spinning ball of claim 9, wherein said fins are arcuate segmental fins which partially encircle said housing.

11. The spinning ball of claim 10, wherein a sum arc of said fins equals 360°, and said fins are equally spaced around the periphery of said housing to insure a uniformly distributed anchoring force.

12. The spinning ball of claim 8, wherein said cylindrical rotator is formed with an annular flange proximate the open end, said flange bearing against the rim of said housing to hold said rotator captive therein.

13. The spinning ball of claim 12, wherein said annular flange of said cylindrical rotator is formed with a graduated ramping cross-section having a precipice facing the open end to allow snap-fit insertion of said rotator in said housing.

14. The spinning ball of claim 12, wherein said cylindrical rotator further comprises, a hard outer shell, and a resilient finger cup inserted within said outer shell and defining a central finger well.

15. The spinning ball of claim 14, wherein said resilient finger cup further comprises a plurality of axially spaced ribs protruding into said central finger well to securely grip a finger inserted therein.

16. The spin fixture of claim 14, wherein said resilient finger cup further comprises a resilient finger collar defined by an annular notch cutting into said finger cup around said central finger well and tapering inwardly from the open end.

17. The spin fixture of claim 16, wherein said finger collar is formed with at least one axial slit for increasing its resiliency when a finger is inserted therein.

* * * * *